US005561697A

United States Patent [19]

Takafuji et al.

[11] Patent Number: 5,561,697

[45] Date of Patent: Oct. 1, 1996

[54] MICROTRON ELECTRON ACCELERATOR

[75] Inventors: Atsuko Takafuji, Tokyo; Katsuya Sugiyama; Katsuhiro Kuroda, both of Hachioji; Keiji Koyanagi; Ichiro Miura, both of Kashiwa; Masatoshi Nishimura, Misato, all of Japan

[73] Assignee: Hitachi Medical, Tokyo, Japan

[21] Appl. No.: 372,124

[22] Filed: Jan. 13, 1995

Related U.S. Application Data

[63] Continuation of Ser. No. 165,919, Dec. 14, 1993, Pat. No. 5,399,873.

[30] Foreign Application Priority Data

Dec. 15, 1992 [JP] Japan ..... 4-334082

[51] Int. Cl.$^6$ ..... H05H 13/00

[52] U.S. Cl. ..... 378/65; 378/121

[58] Field of Search ..... 378/65, 64, 68, 378/119, 121, 137, 138

[56] References Cited

U.S. PATENT DOCUMENTS

| | | | |
|---|---|---|---|
| 4,200,844 | 4/1980 | Nunan | 328/230 |
| 4,705,955 | 11/1987 | Mileikowsky | 250/492.1 |
| 4,726,046 | 2/1988 | Nunan | 250/492.1 X |
| 4,990,861 | 2/1991 | Ernst et al. . | |
| 5,267,294 | 11/1993 | Kuroda et al. | 378/65 |
| 5,332,908 | 7/1994 | Weidlich . | |
| 5,396,889 | 3/1995 | Ueda et al. | 378/65 X |
| 5,399,873 | 3/1995 | Takafuji et al. | 250/492.3 |

FOREIGN PATENT DOCUMENTS 1-31680 6/1989 Japan .

*Primary Examiner*—David P. Porta

*Attorney, Agent, or Firm*—Fay, Sharpe, Beall, Fagan, Minnich & McKee

[57] ABSTRACT

Disclosed is a microtron electron accelerator having an accelerating cavity accepting microwave electric power for generating a high-frequency accelerating electric field E disposed within a uniform magnetic field B and adapted such that electrons are accelerated and caused to move in a circular trajectory under action of the magnetic field B and the electric field E, comprising an electron source formed of a cathode and an anode, which has a minute slit allowing an electron beam extracted from the cathode to pass therethrough, disposed on the outer side of the wall of the accelerating cavity, a first electron beam through-hole and a second electron beam through-hole formed in the wall of the accelerating cavity in two positions, with the electron source therebetween, along the decreasing or increasing direction of the strength of the electric field E in the accelerating cavity, and a third electron beam through-hole formed in the wall of the accelerating cavity in a position in confrontation with the first electron beam through-hole across the inner space of the accelerating cavity. By adopting the above described structure, it has been made possible to have the energy gain within the accelerating cavity at each time of acceleration increased and to have contamination of the inner surface of the accelerating cavity by evaporated cathode material decreased, and as a result, it is made possible to obtain a microtron electron accelerator smaller in size and capable of stably providing a high-energy electron beam.

4 Claims, 6 Drawing Sheets

MICROTRON ELECTRON ACCELERATOR

This is a continuing application of U.S. Ser. No. 08/165,919, filed Dec. 14, 1993, now U.S. Pat. No. 5,399,873.

BACKGROUND OF THE INVENTION

The present invention relates to an improvement of a microtron electron accelerator and more particularly to an improvement in structure of an electron source and an accelerating cavity small in size and suitable for obtaining a high-energy electron beam stably and to optimization of electron accelerating conditions.

The microtron electron accelerator is an apparatus for accelerating electrons with a microwave. A microtron electron accelerator of a conventional structure is formed of an electromagnet 2 for generating a uniform magnetic field B and an accelerating cavity 1 accepting microwave electric power 3 for generating high-frequency accelerating electric field E as shown in FIG. 7. On the inner wall surface of the accelerating cavity 1, there is provided a hot cathode 4. Electrons e are emitted from the hot cathode 4 and accelerated by the high-frequency accelerating electric field E within the accelerating cavity 1. The accelerated electrons e are deflected by the uniform magnetic field B and ejected from the accelerating cavity 1 through a hole 63 allowing electron beam to pass through (hereinafter briefly called "electron beam through-hole") formed in the wall of the accelerating cavity 1. The ejected electrons e draw a circular trajectory 91 in the uniform magnetic field B and are injected into the accelerating cavity 1 through an electron beam through-hole 61. Here, the electrons e are further accelerated by the high-frequency accelerating electric field E and ejected from the accelerating cavity 1 through the electron beam through-hole 63, and, then, they draw a still larger circular trajectory 92 in the uniform magnetic field B and are again injected into the accelerating cavity 1 through the electron beam through-hole 61. Such operations are repeated and, thereby, the electrons e are progressively accelerated to obtain higher energy and trace successively greater trajectories 93, 94, and 95, and trace a final circular trajectory 96 and are extracted from the magnetic field B as electrons with desired energy through an extracting pipe 8 provided in the final circular trajectory 96. Since the amount of the output current flow of the electron beam finally extracted from the apparatus is small with the apparatus of the structure shown in FIG. 7, a proposal to increase the amount of the output current flow by obliquely forming the surface on which the cathode 4 is provided in the accelerating cavity 1, so that the effective cathode area is increased, is disclosed in the gazette of Japanese Patent publication No. Hei 1-31680.

In the above described apparatus of a conventional structure, since the cathode 4 is provided on the inner wall surface of the accelerating cavity 1, the material for cathode evaporated from the heated cathode by heating the cathode 4 was liable to adhere to the inner wall surface of the accelerating cavity 1. Thus, the inner wall surface of the accelerating cavity 1 was contaminated by the adhesion of the evaporated cathode material to it, and because of this, there were caused such problems that the Q-value of the accelerating cavity 1 was decreased making it difficult to satisfactorily accelerate the electrons or discharges were produced due to bad resistivity for voltage. Therefore, it was liable to occur in the apparatus of conventional structure that, while the electron beam accelerating characteristic in the accelerating cavity 1 is satisfactory in the early stage of its use, the electron beam accelerating characteristic in the accelerating cavity 1 becomes gradually deteriorated by aged deterioration due to the above described adhesion of cathode material to it. Thus there has been a problem that an electron beam with a desired large amount of current flow is not obtainable stably.

SUMMARY OF THE INVENTION

Accordingly, an object of the present invention is to solve the above described problems in the apparatus of a conventional structure and to provide a microtron electron accelerator in which the above mentioned contamination of the inner wall surface of the accelerating cavity by evaporated cathode material can be reduced and with which an electron beam with a great amount of current flow can be stably accelerated and output.

In order to achieve the above mentioned object, there is provided, in the present invention, a microtron electron accelerator having an accelerating cavity accepting microwave electric power for generating a high-frequency accelerating electric field E disposed within a uniform magnetic field B generated by a permanent magnet or an electromagnet and adapted such that electrons from an electron source are accelerated stepwise and caused to move drawing circular trajectories under action of the magnetic field B and the electric field E, comprising (a) the electron source formed of a cathode for emitting thermoelectrons and an anode, which has a minute slit allowing electrons extracted from the cathode to pass therethrough, disposed on the outer side of the wall of the accelerating cavity, (b) a first electron beam through-hole and a second electron beam through-hole formed in the wall of the accelerating cavity in two positions, with the electron source therebetween, along the decreasing or increasing direction of the strength of the electric field E in the accelerating cavity, and a third electron beam through-hole formed in the wall of the accelerating cavity in a position in confrontation with the first electron beam through-hole across the inner space of the accelerating cavity. Further, as to the setting of the dimensions of the accelerating cavity and the magnetic flux density of the uniform magnetic field B, optimum conditions to stably obtain an electron beam are taken into consideration.

Although the electron source formed of the cathode and anode is disposed on the outer side of the wall of the accelerating cavity as described above, it is possible to inject the electrons emitted from the cathode into the accelerating cavity through the first electron beam through-hole by making use of movement of the electrons in a circular trajectory within the uniform magnetic field B. Thereby, the contamination of the inner wall surface of the accelerating cavity by the evaporated cathode material described above can be effectively decreased. Further, by providing the anode in front of the cathode, most of the evaporated cathode material adhere to the surface of the anode. By this also, the above mentioned contamination of the inner wall surface of the accelerating cavity can be decreased. As a result, the condition to obtain sufficiently stabilized acceleration of the electron beam can be attained.

DESCRIPTION OF THE PREFERRED EMBODIMENTS

An embodiment of the present invention will be described below in detail with reference to the accompanying drawings.

Figure 1:
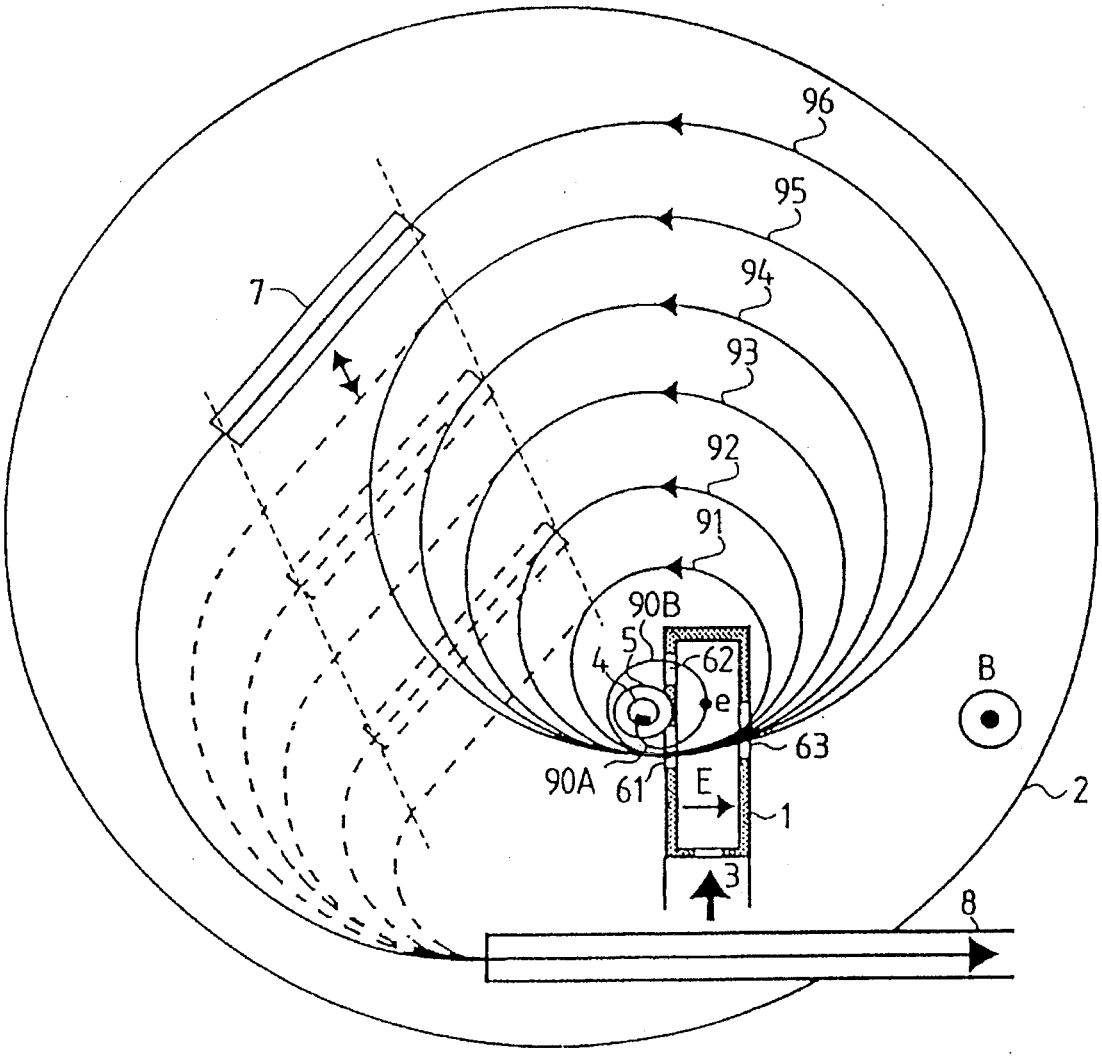
FIG. 1 is a schematic sectional view showing a general structure of a microtron electron accelerator of an embodiment of the invention.

FIG. 1 is a general structural diagram of a microtron electron accelerator according to an embodiment of the invention. In this embodiment, an accelerating cavity 1 in the form of a rectangular parallelepiped resonating within the range from 2.5 to 3.5 GHz is disposed in a uniform magnetic field B generated by an electromagnet 2. In the accelerating cavity 1, a high-frequency accelerating electric field E within the range from 2.5 to 3.5 GHz is generated by microwave electric power 3 input thereto. On the outer side of the wall of the accelerating cavity 1, there is provided an electron source formed of a cathode 4 and an anode 5 which are arranged coaxially. More specifically, the cathode 4 is attached to a portion of a cylindrical supporting bar and the anode 5 is shaped in a cylindrical form to surround the cathode 4, and the cylindrical anode 5 has a small slit allowing the electron beam e from the cathode 4 to pass therethrough formed in a position of it.

In the wall of the accelerating cavity 1, there are formed a first electron beam through-hole 61, a second electron beam through-hole 62, and a third electron beam through-hole 63, allowing the electron beam e to pass therethrough. Here, the first electron beam through-hole 61 is formed in a position of the wall surface near the position of installation of the electron source and where the high-frequency accelerating electric field E is stronger, the second electron beam through-hole 62 is formed in a position of the wall surface similarly near the position of installation of the electron source but where the high-frequency accelerating electric field E is weaker, and the third electron beam through-hole 63 is formed in a position of the wall surface in confrontation with the first electron beam through-hole 61 across the inner space of the accelerating cavity 1.

Within the uniform magnetic field B, there are provided a deflection pipe 7 for deflecting the trajectory of the electron beam e and an extraction pipe 8 for extracting the electron beam e from the apparatus (from the uniform magnetic field B). These pipes 7 and 8 change the trajectory of the electron beam e by shielding the uniform magnetic field B. The deflection pipe 7 is adapted to be movable in the plane including the trajectories of the electron beam e in it in the directions indicated by the arrow heads in the diagram and the extraction pipe 8 is generally fixed.

Now, operations of the apparatus structured as above will be described. Thermoelectrons e are extracted from the heated cathode 4 by the anode-to-cathode voltage (electron extracting voltage). The extracted electrons e draw a circular trajectory 90A within the uniform magnetic field B generated by the electromagnet 2 and, then, they are injected into the accelerating cavity 1 through the first electron beam through-hole 61. Since there are present of the high-frequency accelerating electric field E at within the range from 2.5 to 3.5 GHz in addition to the uniform magnetic field B in the accelerating cavity 1, the electrons e are accelerated by the high-frequency accelerating electric field E while they are deflected by the uniform magnetic field B. The accelerated/deflected electrons e ejected from the accelerating cavity through the second-electron beam through-hole 62. The ejected electrons e travel within the uniform magnetic field B drawing a circular trajectory 90B to return to the accelerating cavity 1 and are again injected into the accelerating cavity 1 through the first electron beam through-hole 61. Here, the electrons e are accelerated by the high-frequency accelerating electric field E so as to have higher energy and the thus accelerated electrons e ejected from the accelerating cavity through the third electron beam through-hole 63 this time, return to the accelerating cavity 1 again after drawing a circular trajectory 91 with a greater trajectory radius than before, and are injected into the accelerating cavity 1 again through the first electron beam through-hole 61. Such operations are repeated in succession, and, in the meantime, the electrons e are accelerated one step each time while they are successively shifted from the circular trajectory 91 to the circular trajectory 96. Then, by moving the deflection pipe 7 into a specific circular trajectory drawn by electrons with desired energy, the electrons in that circular trajectory are deflected through the deflection pipe 7 from the circular trajectory to be introduced into the extraction pipe 8 and extracted to outside the uniform magnetic field B trough the extraction pipe 8.

Optimum designing conditions of the apparatus with the above described structure were searched for by analysis of electron beam trajectory through computer simulation. As the result, the optimum conditions were set up as follows.

Figure 2:
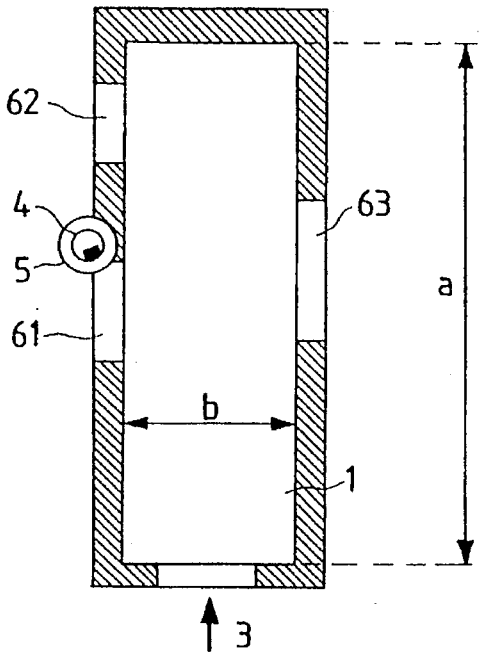
FIG. 2 is a schematic sectional view showing a detailed structure of the accelerating cavity in the apparatus shown in FIG. 1.
Figure 3:
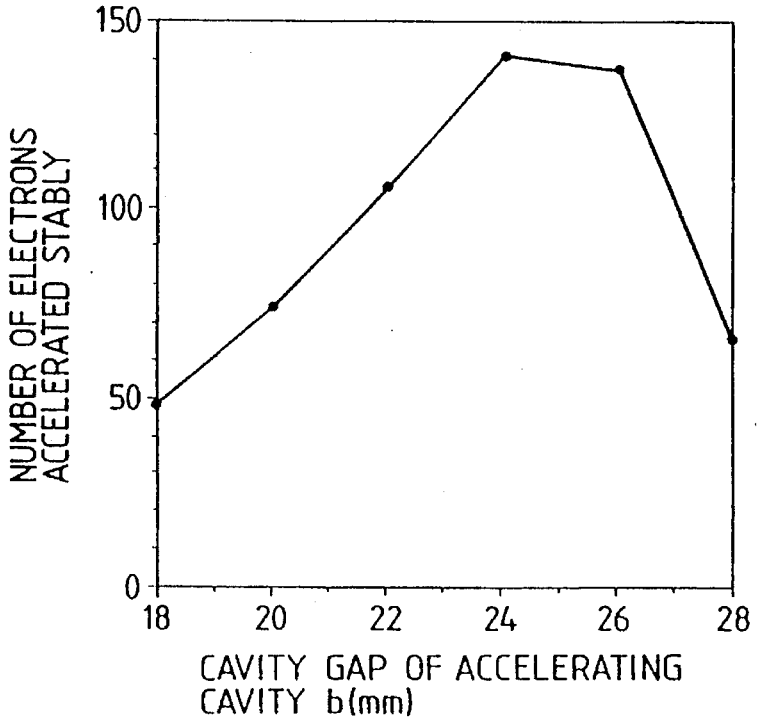
FIG. 3 is a graph explanatory of an optimum condition in the apparatus shown in FIG. 1.

Detailed structure of the accelerating cavity 1 of FIG. 1 is shown in FIG. 2. First, the finding through the computer simulation of the optimum b-dimension of the accelerating cavity 1 shaped in-the form of a rectangular parallelepiped is shown in FIG. 3. The term "number of electrons accelerated stably" represented by the axis of ordinates of FIG. 3 means the number of electrons which acquired desired energy through acceleration in the analysis of electron beam trajectory conducted with the angle of emission of electrons from cathode and the initial phase on injection minutely varied, where the angle of emission of electrons from cathode is the direction of emission of the electrons from the cathode 4 when the direction of the high-frequency accelerating electric field E is set to 0°, and the initial phase on injection is the phase of the microwave supplied when the electrons from the cathode 4 are first injected into the accelerating cavity 1. In the simulation, the above described angle of emission from cathode was changed to take up 17 points at intervals of 5° within an optimum range of 80° in the range from 250° to 360° and the above described initial phase on injection was changed to take up 180 points at intervals of 2° in the range from 0° to 360° for each of the 17 points. Hence, the trajectory of electrons was calculated for each of totally 3060 cases. From FIG. 3, it was found out that the range of the b-dimension within which a large beam current is-obtained is from 18 to 28 mm. Also, it was found as to the a-dimension of the accelerating cavity 1 in the rectangular parallelepiped form as the results of similar simulation that the optimum range is from 70 to 90 mm.

Figure 4:
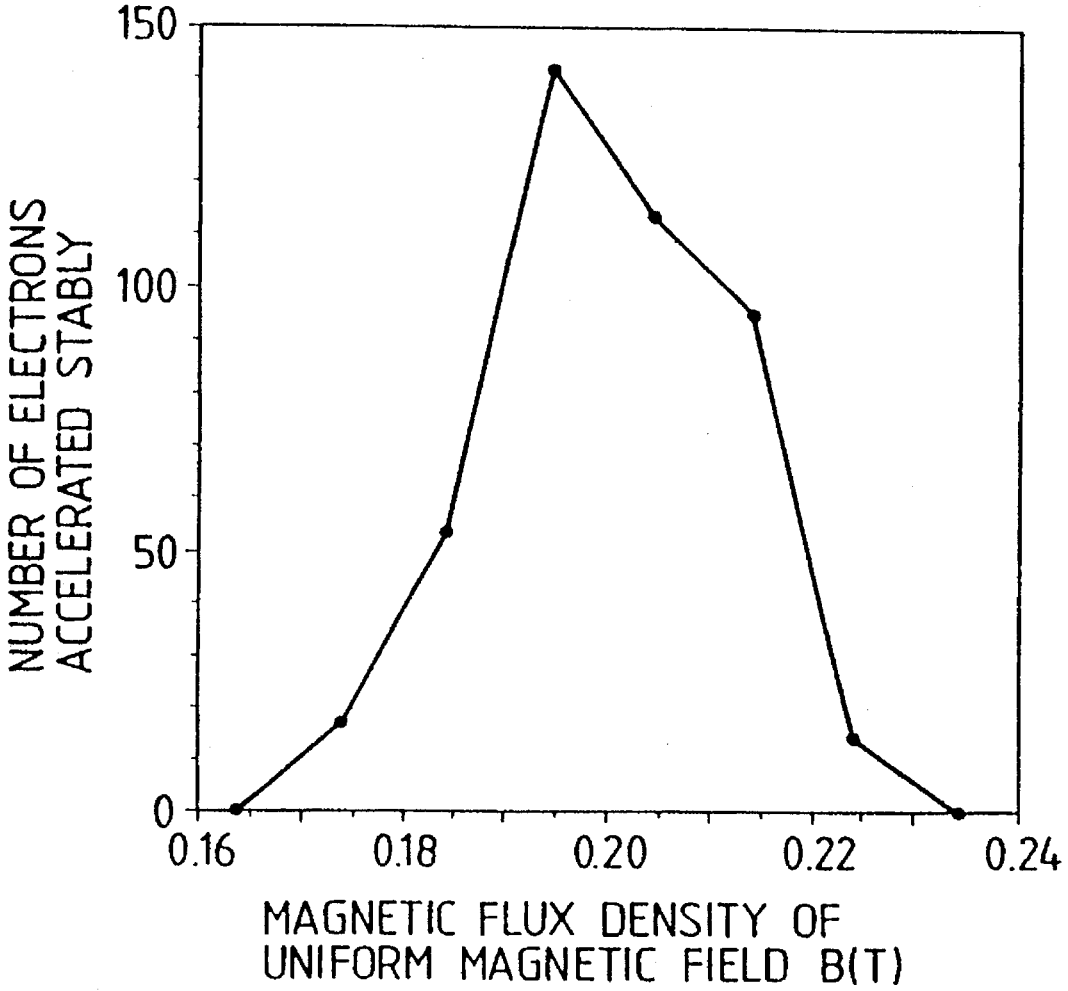
FIG. 4 is another graph explanatory of an optimum condition in the apparatus shown in FIG. 1.

The finding of the optimum value of the magnetic flux density of the uniform magnetic field B through computer simulation is shown in FIG. 4. From the result, it was found out that the optimum magnetic flux density of the uniform magnetic field B is in the range from 0.17 to 0.23 T.

According to the above described results of simulation, the following structure was adopted in the present embodiment. First, as to the size of the accelerating cavity 1, the a-dimension was set to 80 mm and the b-dimension was set to 24 mm. Further, the magnetic flux density of the uniform magnetic field B was set to 0.194 T.

The point characteristic of the present embodiment is that great acceleration (energy gain) can be provided to the electrons e in the accelerating cavity 1 each time. In this embodiment, an energy gain of 0.925 MeV was obtained each time. In the present embodiment, it is possible to obtain electron beams with various quantities of energy from the fixed-extraction pipe 8 by shifting the deflection pipe 7. In concrete terms, by changing the acceleration in up to 22 steps, electron beams having kinetic energy in a wide range from 4.114 to 20.764 MeV in increments of 0.925 MeV can be obtained. Amounts of the current provided by the electron beams in this case were approximately 150 mA when the kinetic energy was 4.114 MeV and approximately 20 mA when it was 20.76 MeV.

Since the microtron electron accelerator according to the present embodiment can provide a great energy gain in the accelerating cavity 1 in one time, such a merit is obtained that the apparatus for obtaining an electron beam with desired energy can be markedly decreased in size.

The microtron electron accelerator of the present embodiment can be applied to a medical electron (or X-ray) irradiation apparatus. More specifically, by arranging, as shown in FIG. 5, such that an electron beam e extracted from a microtron electron accelerator 101 through an extraction pipe 8 is led by means of quadrupole lens, deflector, and the like to an irradiation head 103 within a gantry 104 rotating around a patient 102 and the electron beam e as it is (or after it has been converted to an X-ray 105) is used for irradiating the patient 102, the microtron electron accelerator can be applied to a medical electron (or X-ray) irradiation apparatus.

Figure 5:
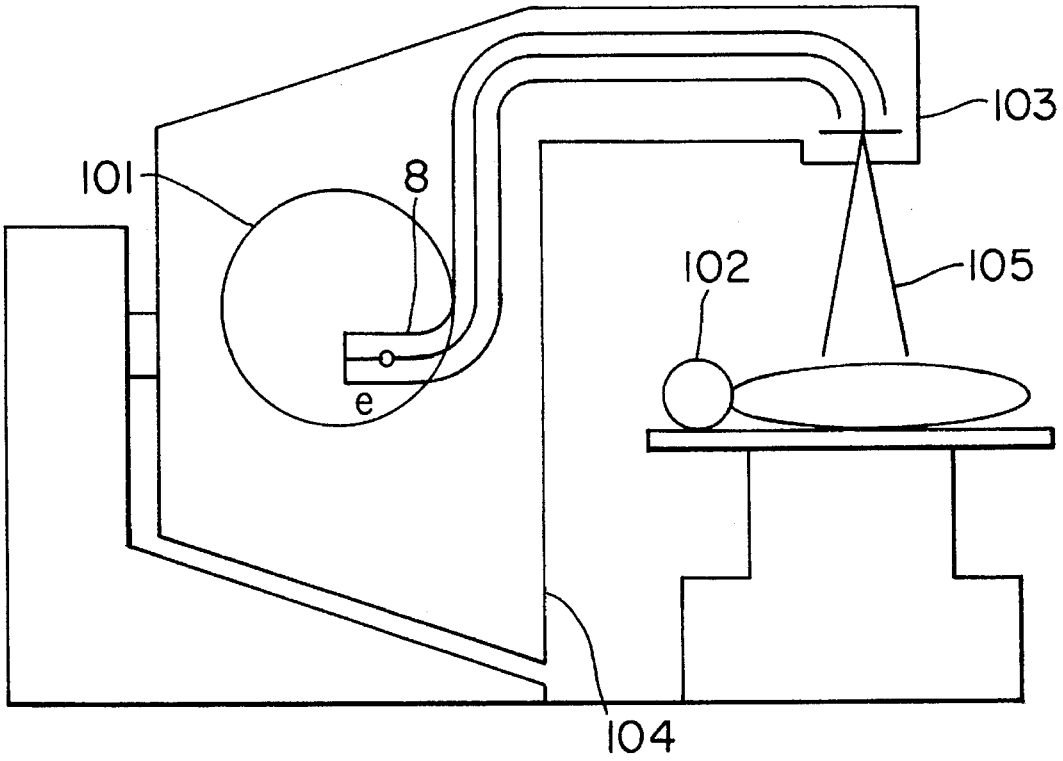
FIG. 5 is a schematic sectional view showing a general structure of a medical apparatus to which the microtron electron accelerator of the present invention is applied.

Further, since the microtron electron accelerator of the present embodiment even of a small size can provide a high-energy electron beam as described above, for example, by incorporating the portion of the accelerator 101 shown in FIG. 5 in a rotating gantry 104, it becomes possible to realize a markedly small-sized medical electron (or X-ray) irradiation apparatus.

According to the present embodiment, since it is arranged such that the electron source formed of the cathode 4 and anode 5 is installed on the outer side of the wall of the accelerating cavity 1 and, in addition, most of the evaporated cathode material adhere to the anode 5, it has become possible to markedly decrease contamination of the inner wall surface of the accelerating cavity 1 by the evaporated cathode material. As a result, it has become possible to prevent the deterioration in the accelerating characteristic of the accelerating cavity 1 due to its aged deterioration. Further, since the size of each portion of the apparatus and the operating conditions are set in optimum ranges, it has become possible to accelerate the electron beam more stably.

Although the invention has been described in its preferred embodiment, the invention is not limited to the above described embodiment but various modifications as described below may be made. For example, while the cathode 4 and the anode 5 were arranged coaxially in the above embodiment, they may be arranged in other ways if the electrons e can only be extracted from the cathode 4 by the potential difference between the cathode 4 and the anode 5.

Although within the range from 2.5 to 3.5 GHz was adopted to the frequency of the supplied microwave 3 in the above embodiment, this can be set to any other frequency provided that it satisfies the condition of synchronism of the microtron. The form of the accelerating cavity 1 is not limited to the rectangular parallelepiped form. Only required is that the accelerating cavity is of such a form that a high-frequency accelerating electric field E is generated within the cavity 1 by the supply of microwave electric power 3 thereto.

Figure 6:
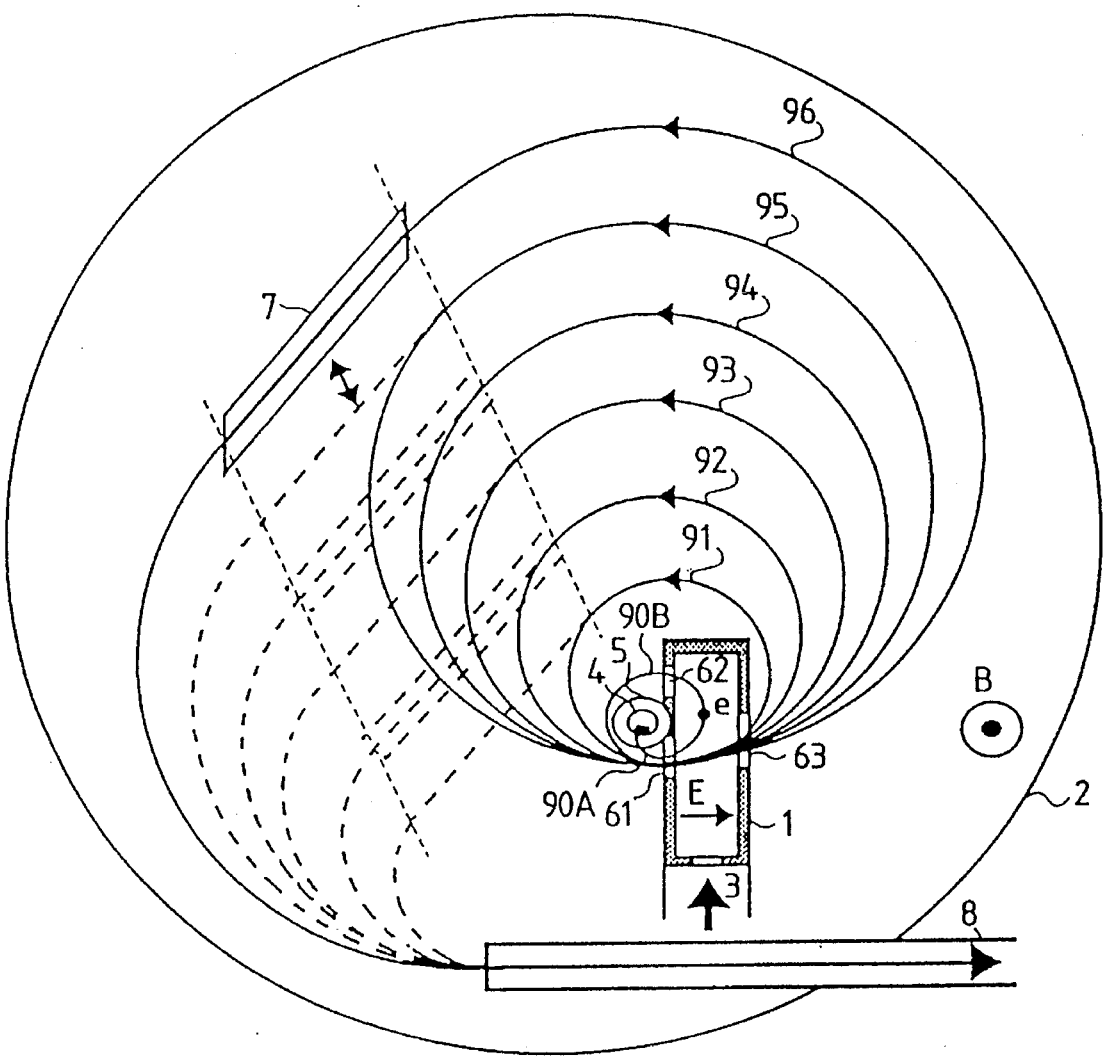
FIG. 6 is a schematic sectional view showing a general structure of a microtron electron accelerator of another embodiment of the invention.
Figure 7:
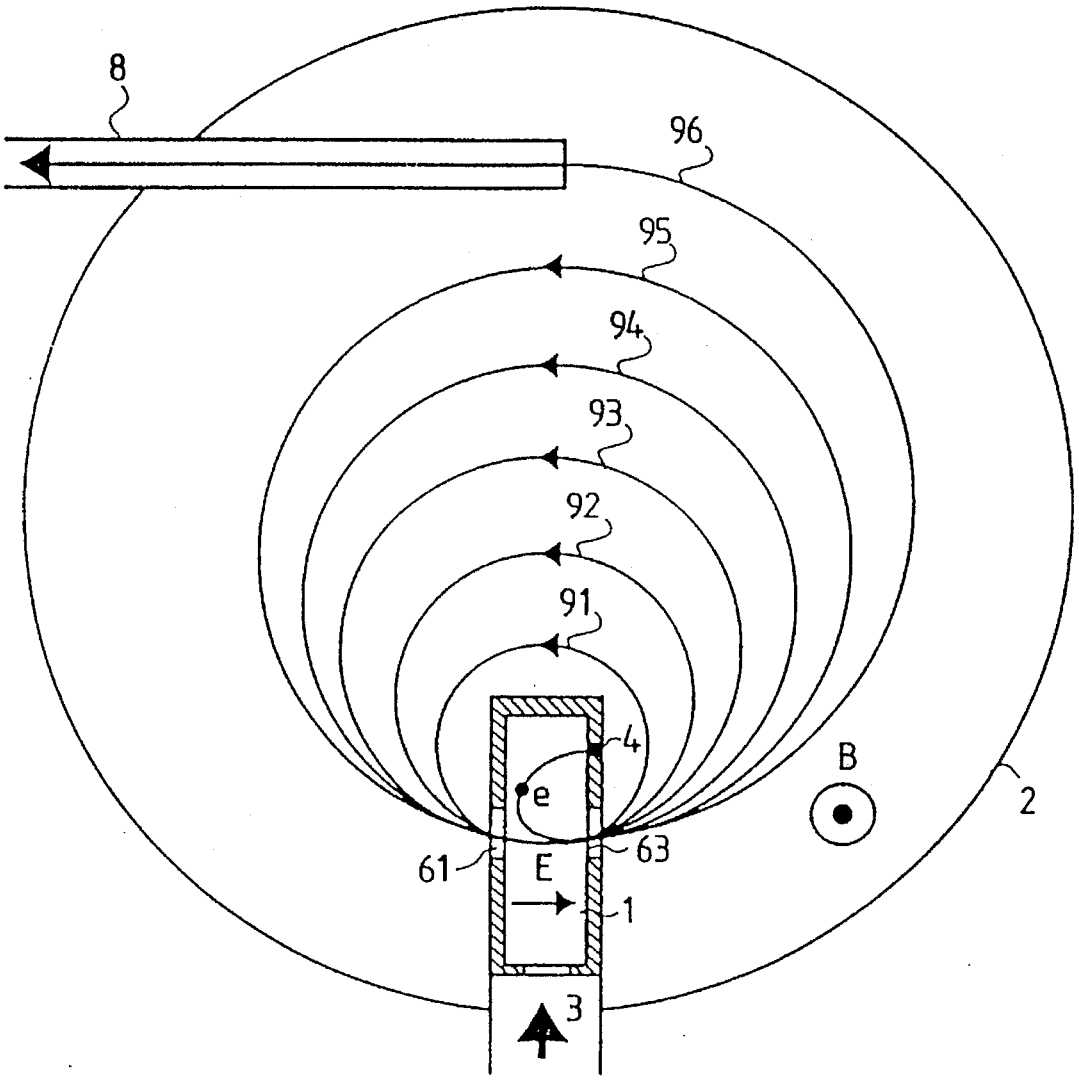
FIG. 7 PRIOR ART
FIG. 7 is a schematic sectional view showing a general structure of a microtron electron accelerator of conventional structure.

Although the electron beam extracting mechanism was formed of a movable deflection pipe 7 and a stationary extraction pipe 8 in the above embodiment, it is not limitative. Further, the end face of each of the deflection pipe 7 and the extraction pipe 8 in the above embodiment was shown to be perpendicular to the axis of each pipe, but the end face may be formed not to be perpendicular to the axis of each pipe. As an example, FIG. 6 shows a case where the deflection pipe 7 has both of its end faces on the inlet side and on the outlet side of the electron beam formed not to be perpendicular to the axis of the pipe. By arranging so, the shape of the uniform magnetic field shielding region by the deflection pipe 7 or the extraction pipe 8 can be changed and, hence, the deflection pipe 7 or the extraction pipe 8 can have the lens effect on the electron beam. By providing the lens effect to the deflection pipe 7 or the extraction pipe 8 in this way, it becomes possible to restrain the divergence of the electron beam and obtain the electron beam more efficiently.

Although, in the above embodiment, the case where the apparatus is used for medical application is shown, but it is not limitative. For example, the apparatus can be used as an injector for an SOR (Synchrotron Orbital Radiation) ring.

As described above in detail, according to this invention, since contamination of the inner wall surface of the accelerating cavity by evaporated cathode material can be markedly decreased, a remarkable merit is obtained that the deterioration in the characteristic of the accelerating cavity due to its aged deterioration can be prevented.

Further, since the energy gain of an electron beam in the accelerating cavity in one time of acceleration can be increased, such a merit is also obtained that the apparatus can be made smaller in size and capable of obtaining higher energy. Further, since optimum structure and optimum operating conditions have been established, such a merit is obtained that an electron beam can be accelerated stably.

What is claimed is:

1. An X-ray irradiating apparatus for irradiating an X-ray beam to an object to be irradiated, comprising:

a microtron electron accelerator for generating an accelerated electron beam;

an X-ray irradiation head for converting said accelerated electron beam generated by said microtron electron accelerator into an X-ray beam and directing said X-ray beam toward said object;

a rotating gantry for rotating said X-ray irradiation head around said object;

wherein said microtron electron accelerator is incorporated into said rotating pantry; and wherein said microtron electron accelerator has an accelerating cavity accepting microwave electric power for generating a high-frequency accelerating electric field E disposed within a uniform magnetic field B such that electrons are accelerated and caused to move in a circular trajectory under action of the magnetic field B and the electric field E; and said microtron electron accelerator further includes an electron source formed of a cathode and an anode which has a minute slit allowing the electron beam extracted from said cathode to pass therethrough and disposed on the outer side of the wall of said accelerating cavity; a first electron beam through-hole and a second electron beam through-hole formed in the wall of said accelerating cavity in two positions, with said electron source therebetween, along the decreasing or increasing direction of the strength of the electric field E in said accelerating cavity; and a third electron beam through-hole formed in the wall of said accelerating cavity in a position in confrontation with said first electron beam through-hole across the inner space of said accelerating cavity.

2. An X-ray irradiating apparatus according to claim 1, wherein said accelerating cavity is shaped in the form of a rectangular parallelepiped, and the dimensions of said accelerating cavity are set within a range from 70 to 90 mm in the propagating direction of the microwave supplied to said accelerating cavity and within a range from 18 to 28 mm in the direction of the high-frequency electric field E.

3. An X-ray irradiating apparatus according to claim 1, wherein the frequency of the microwave supplied to said accelerating cavity is set within the range from 2.5 to 3.5 GHz.

4. An X-ray irradiating apparatus for irradiating an X-ray beam to an object to be irradiated, comprising:

a microtron electron accelerator for generating an accelerated electron beam;

an X-ray irradiation head for converting said accelerated electron beam generated by said microtron electron accelerator into an X-ray beam and directing said X-ray beam toward said object; and a rotating gantry for rotating said X-ray irradiation head around said object;

wherein said microtron electron accelerator is constructed so as to cause said accelerated electron beam to move in a circular trajectory under action of a uniform magnetic field and is incorporated into said rotating gantry.

* * * * *